US007228100B2

(12) United States Patent
Toporski et al.

(10) Patent No.: US 7,228,100 B2
(45) Date of Patent: Jun. 5, 2007

(54) PROGRAM DATA DISPLAY IN DUPLICATIVE DIGITAL AUDIO BROADCASTING SYSTEM

(75) Inventors: Todd A. Toporski, Northville, MI (US); J. William Whikehart, Novi, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 595 days.

(21) Appl. No.: 10/397,037

(22) Filed: Mar. 25, 2003

(65) Prior Publication Data

US 2004/0192191 A1 Sep. 30, 2004

(51) Int. Cl.
*H04H 7/00* (2006.01)

(52) U.S. Cl. ..... 455/3.06; 455/3.01; 375/260; 375/268; 375/271

(58) Field of Classification Search ..... 455/427, 455/13.1, 12.1, 3.01–3.06; 375/260, 268, 375/271

See application file for complete search history.

(56) References Cited

U.S. PATENT DOCUMENTS

| | | | | |
|---|---|---|---|---|
| 5,900,915 | A | 5/1999 | Morrison | |
| 6,243,424 | B1 | 6/2001 | Kroeger et al. | |
| 6,415,135 | B1 | 7/2002 | Salomäki | |
| 6,470,497 | B1 | 10/2002 | Ellis et al. | |
| 6,490,432 | B1 | 12/2002 | Wegener et al. | |
| 6,622,007 | B2 * | 9/2003 | Linden | 455/12.1 |
| 6,901,242 | B2 * | 5/2005 | Kroeger et al. | 455/45 |
| 2001/0021231 | A1 * | 9/2001 | Kroeger et al. | 375/316 |
| 2003/0207669 | A1 * | 11/2003 | Kroeger | 455/3.06 |

* cited by examiner

*Primary Examiner*—Edward F. Urban
*Assistant Examiner*—Raymond S. Dean
(74) *Attorney, Agent, or Firm*—Brinks Hofer Gilson & Lione

(57) ABSTRACT

Program data is provided in association with a main audio program to a receiver of a duplicative radio broadcasting system wherein a duplicative broadcast (such as a hybrid IBOC broadcast) includes a primary channel and a backup channel in a predetermined frequency allocation. Both the primary channel and the backup channel transmit the main audio program, and the primary channel transmits program data not included in the backup channel. The receiver includes an audio output for reproducing the main audio program and a display for displaying the program data. The method includes recurrently compiling a program event list of the program data corresponding to a current program event and a plurality of upcoming program events. The program event list is recurrently transmitted within the primary channel. The receiver recurrently recovers the program event list and stores the program data in a memory. The program data of the current program event is displayed. The audio output is blended from the primary channel to the backup channel in response to detection of an impaired primary channel. The display is updated to show program data of one of the upcoming program events from the memory during impairment of said program data in said primary channel.

26 Claims, 5 Drawing Sheets

47

| PEN | PET | PED | ERT | PAD |
|---|---|---|---|---|
| -1 | 0 | 191040 | 0 | Title-1, Artist-1, Genre-1 |
| 0 | 1 | 60000 | 0 | Commercial0 |
| 1 | 0 | 240000 | 5400 | Title1, Artist1, Genre1 |
| 2 | 0 | 235000 | 235000 | Title2, Artist2, Genre2 |
| 3 | 1 | 122260 | 122260 | Commercial1 |
| 4 | 2 | 56000 | 56000 | DJ Contest Info |
| 5 | 0 | 265000 | 265000 | Title3, Artist3, Genre3 |
| ... | ... | ... | ... | ... |

Fig. 4

| *Header* | *Extended Header* | | | | *Data* | |
|---|---|---|---|---|---|---|
| Standard Header | PEN | PET | PED | ERT | ID3 Tag | Other Data |

Fig. 8

| *Frame Header* | | | *Frame Data* |
|---|---|---|---|
| Frame ID | Size | Flags | <<PEI;PEN;PET;PED;ERT>>; text |

Fig. 9

| *Comment Frame Header* | | | *Comment Frame Data* | | | |
|---|---|---|---|---|---|---|
| Frame ID | Size | Flags | Text Encoding | Lang. | Short Desc. | <<PEI;PEN;PET;PED;ERT>>; Text Frame Header and Data |

Fig. 10

| *Frame Header* | | | *Frame Data* |
|---|---|---|---|
| Frame ID | Size | Flags | PEN/PET/PED/ERT <Text Frame Header and Data> ... |

Fig. 11

PROGRAM DATA DISPLAY IN DUPLICATIVE DIGITAL AUDIO BROADCASTING SYSTEM

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to duplicative terrestrial digital audio broadcasting systems such as an in-band on-channel (IBOC) hybrid digital and analog radio system, and, more specifically, to controlling a data display of a radio receiver to display program data.

A duplicative radio broadcast system simultaneously transmits 1) a primary channel having at least a main program content and preferably including a supplemental data stream, and 2) a backup channel with main program content that is at least a partial duplicate of the main program content in the primary channel but usually without all or part of the supplemental data stream. Certain differences in the backup channel transmission allow it to be received by a receiver under conditions in which the primary channel is unreceivable.

To accomplish a transition from traditional analog AM and FM broadcast radio services to terrestrial digital audio broadcasting (DAB), hybrid systems are being employed so that existing analog receivers can continue to receive the broadcasts while new digital receivers can be used to receive a higher quality digital signal that is simulcast with the analog signal. In the IBOC hybrid system, both the digital and analog signals are contained within the allocated frequency range of a particular broadcasting station. Typically, the analog signal is transmitted in a center portion with the digital signal occupying upper and lower sideband portions within the range.

Due to differences in transmission power levels, propagation, and performance in fringe areas, the coverage area of the analog signal within which a useful signal can be received is typically larger than the coverage area for the digital signal. Because of this difference in coverage area and because not all broadcasting stations will add digital technology at the same time, digital receivers are designed to receive in either a digital mode or an analog mode. A digital receiver uses the digital signal as its primary channel and the analog signal as a backup channel for receiving a particular broadcast. When both a digital and an analog signal are received, the receiver may blend in a continuous manner from the digital signal to the analog signal (i.e., add the signals in relative proportion to their quality) when the quality of the digital signal deteriorates.

Eventually, hybrid IBOC stations may transition to an all digital broadcast while retaining the duplicative nature of the broadcast signal (i.e., both the primary and backup channels are digital). In the all digital duplicative system, the backup channel transmits at a lower effective data rate and can be received during times that (or at a place where) the primary channel is impaired. In order to achieve a lower data rate, all or part of the supplemental data and possibly some portion of the main program content are omitted from the backup channel (e.g., by encoding the main audio program at a lower bit rate).

In addition to improved signal quality, a digital broadcast enables the transmission of supplemental digital data along with the main audio program of a radio broadcast. The supplemental digital data may include program data (PD) which relates to the main audio program or may include auxiliary data services. As used herein, program data includes any program data services such as station identification or conventional program-associated data (PAD) or any other auxiliary data that may be broadcast for providing information to a user of a receiver. When the main audio program includes music selections, for example, conventional PAD may include song title, artist, genre, album, or other song information. Such data is communicated (i.e., displayed) to the radio user on a graphical or text display integrated with the receiver or may be reproduced (i.e., displayed) as spoken audio using a text-to-speech converter. The program data may also include text messages during other broadcast segments such as commercial messages and talk segments.

When the digital signal in the primary channel is impaired or not available for any reason, the radio receiver blends to or entirely switches over to the analog or digital signal in the backup channel. Once a good signal is present again in the primary channel, the receiver will blend back to the primary. When the digital signal is impaired and the backup channel analog signal is utilized, at least a portion of the program data will no longer be received. In prior art radio receivers, data is processed in real time and typically appears in the display only for as long as the data is being received. Thus, when the digital transmission is lost, program data being displayed may disappear even though the main audio program continues to play. A radio listener may see a song title or artist name being displayed at one moment and then have no information or a blank display at the next moment if blend to analog has occurred. However, the radio listener would prefer the data display to be continuous and not be intermittent depending on signal conditions.

SUMMARY OF THE INVENTION

The present invention has the advantage that if the reception of the supplemental digital data in the primary channel is impaired for a period of time, the program data can still be displayed to the listener (e.g., by a visual display or by audio reproduction of the program data). Furthermore, data can be buffered and is then available when returning to a station after having tuned off it briefly, thereby saving several seconds to acquire new data to display. Also, the listener may be given the ability to scroll through program data for upcoming and past selections that are stored in a memory.

In one aspect of the invention, a method provides program data in association with a main audio program to a receiver of a duplicative radio broadcasting system wherein a duplicative broadcast includes a primary channel and a backup channel in a predetermined frequency allocation. Both the primary channel and the backup channel transmit the main audio program, and the primary channel transmits program data not included in the backup channel. The receiver includes an audio output for reproducing the main audio program and a display for displaying the program data. The method includes recurrently compiling a program event list of the program data corresponding to a current program event and a plurality of upcoming program events. The program event list is recurrently transmitted within the primary channel. The receiver recurrently recovers the program event list and stores the program data in a memory. The program data of the current program event is displayed. The audio output is blended from the primary channel to the backup channel in response to detection of a impaired primary channel. The display is updated to show program data of one of the upcoming program events from the memory during impairment of said program data in said primary channel.

BRIEF DESCRIPTION OF THE DRAWINGS

FIG. 4 is a table showing a program event list stored in a memory of a radio receiver.

FIGS. 8–11 illustrates several protocols for transmitting program event lists within a digital broadcast.

DETAILED DESCRIPTION OF PREFERRED EMBODIMENTS

The present invention defines a "program event" during any particular broadcast as any event that lasts for some finite duration such as a song, commercial, talk segment, or test tone, for which particular program data is to be displayed. A program event may also include an event for which no program data is to be displayed (i.e., a blank display). The broadcaster transmits digital data comprising a program event list which encapsulates the program data with event descriptors, including a program event number (PEN), a program event type (PET), a program event duration (PED), and an event remaining time (ERT), for example. By broadcasting data for multiple program events, the radio receiver can receive and store information about current, past, and upcoming broadcast material and utilize the data for presentation on the display.

Figure 1:
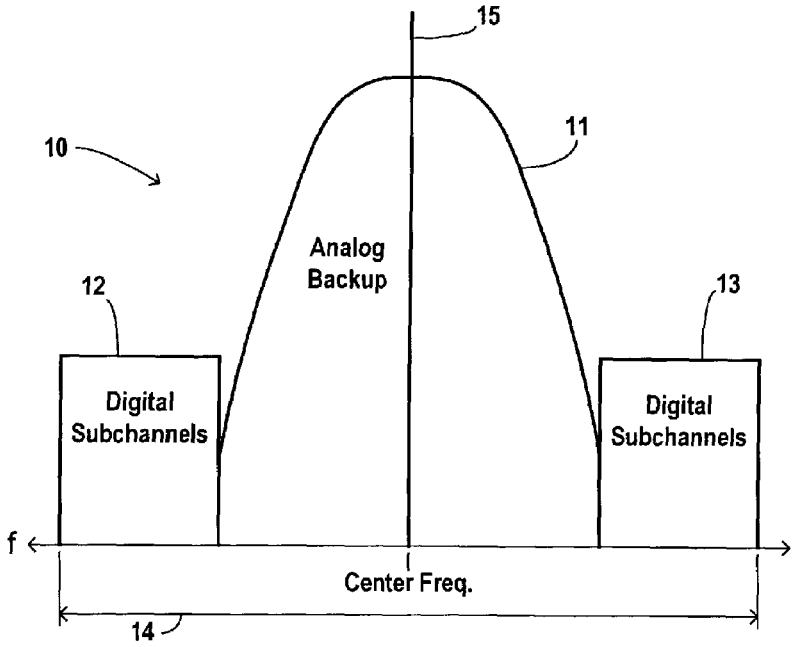
FIG. 1 is a frequency spectrum showing an IBOC transmission signal.

Referring to FIG. 1, one example of a duplicative broadcast system is shown comprising a hybrid digital/analog IBOC system. A spectrum 10 of an IBOC radio transmission includes an analog backup channel 11 and a digital primary channel including lower digital sideband 12 and upper digital sideband 13. The transmission is contained in a frequency allocation 14 and has a center frequency 15. An analog receiver is responsive to the analog backup channel 11 for reproducing the main audio program while a digital receiver is responsive to both analog backup channel 11 and the digital subchannels within digital sidebands 12 and 13. In an all digital duplicative system, the backup digital channel may be broadcast within the central frequency range formerly occupied by the analog channel, for example.

Figure 2:
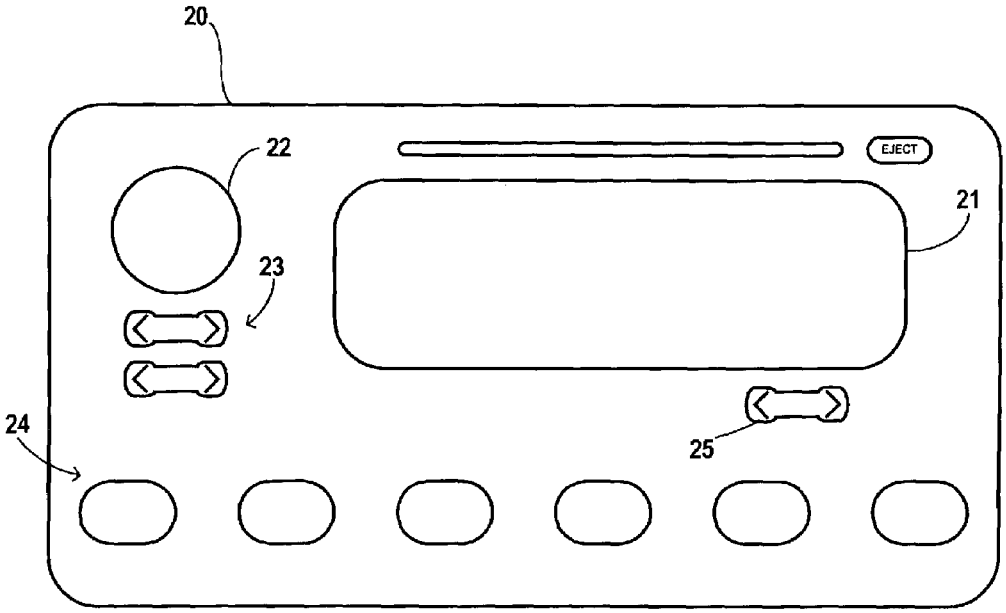
FIG. 2 is a front plan view of a radio receiver.

Referring to FIG. 2, a hybrid digital/analog radio receiver 20 includes a display 21 for displaying program data during reception of an IBOC signal. Conventional radio control elements 22, 23, and 24 are provided for radio operation including power on/off, volume, tuning, and other functions. A rocker switch 25 is provided for scrolling through program data for a current event and upcoming and past events as described below. Other operator interface elements, such as a touch-screen display can also be used.

Figure 3:
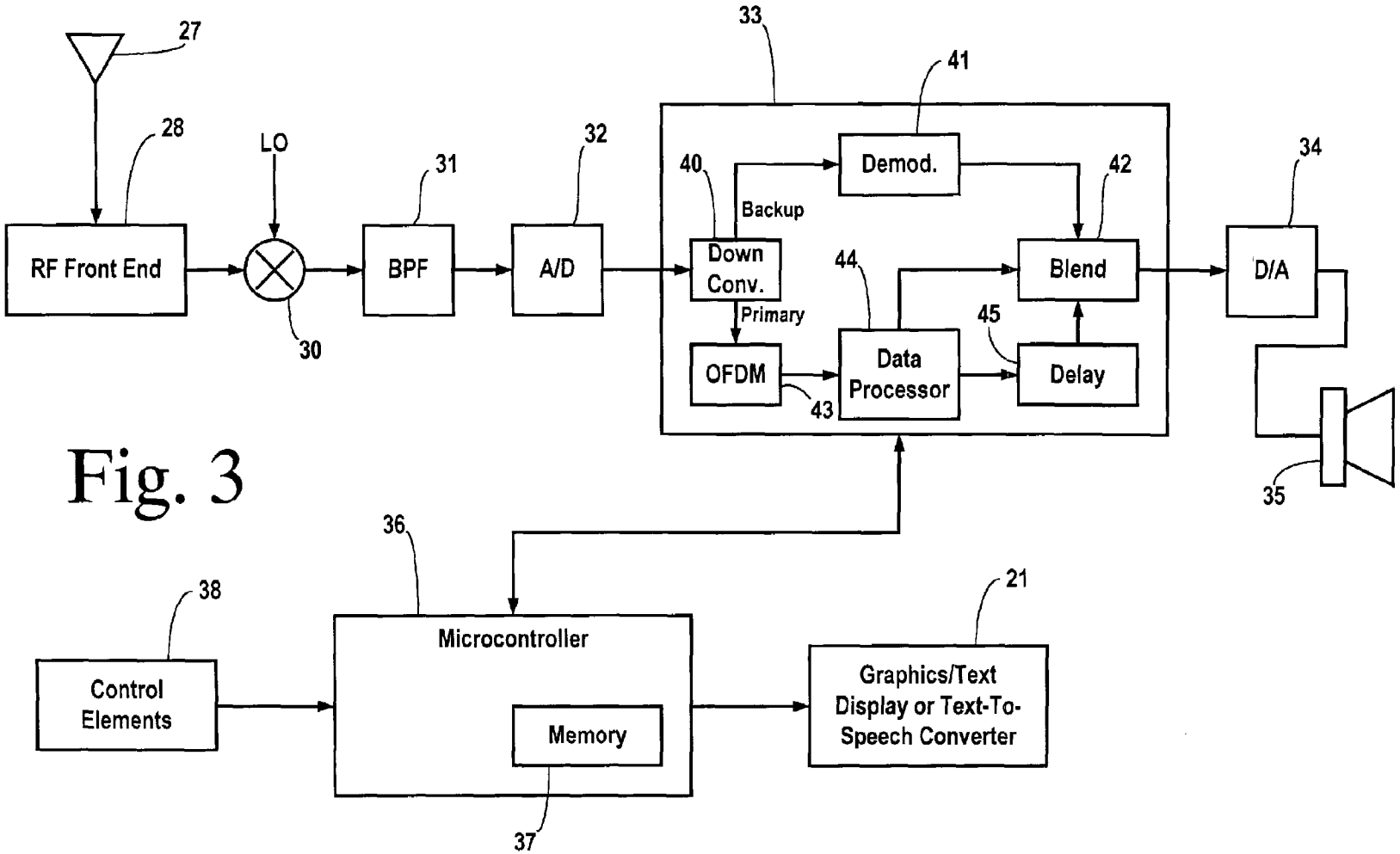
FIG. 3 is a block diagram showing a radio receiver for a hybrid digital/analog broadcast service.

FIG. 3 shows radio receiver 20 in greater detail. An antenna 27 is connected to a RF front end 28, which provides a selected RF broadcast signal to a mixer 30. A local oscillator signal LO is coupled to the other input of mixer 30 for converting the RF signal to an intermediate frequency (IF) signal which is selected by a bandpass filter 31, digitized by an analog-to-digital converter 32, and processed in a digital signal processor (DSP) module 33. The resulting audio signal corresponding to the main audio program being broadcast is converted to analog in a digital-to-analog converter 34 and reproduced by a loudspeaker system 35.

A main microcontroller 36 coordinates operation of the radio receiver and receives digital data from DSP 33. A memory 37 stores a program event list to be displayed on graphics/text display 21. Memory 37 may be integrated with microcontroller 36 or may be comprised of a separate memory device. Control elements 38 are connected to microcontroller 36 for providing user input.

DSP 33 includes a down converter 40 (e.g., a synchronous mixer) for generating a zero IF signal. Using bandpass filtering within down converter 40, the analog transmission portion of the IF signal is coupled to a demodulator 41 for detecting the amplitude modulated signal and providing the recovered main audio program signal to a blend circuit 42. The digital portions of the IF signal are provided to an orthogonal frequency division multiplexing (OFDM) detector 43 for providing the digital signals from all the digital sub-channels to a data processor 44. The digital version of the main audio program is provided from data processor 44 through a delay block 45 to blend circuit 42. The delay is necessary to realign the analog and digital signals because the analog signal is broadcast in time diversity (i.e., with a delay).

Data processor 44 monitors the signal quality of the received digital signal in order to control blend circuit 42. For example, a data error rate of the digital signal may be monitored and compared with a predetermined threshold (e.g., a 10% bit error rate) to detect a impaired digital signal. As long as digital reception is not impaired, program data is delivered to microcontroller 36.

FIG. 4 shows a program event list 47 which may be transmitted as digital data and stored in memory by the radio receiver. Each row of table 47 corresponds to a respective program event and includes a program event number (PEN), a program event type (PET), a program event duration (PED), an event remaining time (ERT), and program data that is shown as program-associated data (PAD) in a preferred embodiment. PEN #1 represents a current program event that is currently playing in the main audio program and the remaining positive PEN numbers represent upcoming events in sequential order. PEN #0 represents the last selection played and increasingly negative PEN numbers represent older events in sequential order. Only a limited number of past events is retained in memory and once the memory is full, the oldest past events would be discarded.

In one preferred embodiment of the invention, only program event numbers and program data are broadcast. In such an embodiment, automatic updating of the display is not possible during times that digital data is not received, but the user can scroll from a current event to upcoming events and can typically determine the correct program data for the main audio program currently playing. Scrolling can be controlled by the operator using manual control elements on the radio bezel or using spoken commands when a receiver is equipped with voice recognition, for example.

In enhanced embodiments, timing information (e.g., the PED and/or the ERT) is provided for automatic updating of the display.

The PEN may be comprised of 4 bits for defining up to 16 program events. The PET may also comprise 4 bits for defining up to 16 event types such as song, commercial, talk segment, talk program, test message, or blank time. The PED and ERT may each be comprised of 3 bytes of 8 bits each for representing duration and remaining time in milliseconds (or any other desired unit). A broadcaster tracks their playlist and other scheduled content in order to generate and schedule program events with the specified PEN's, PET's and PED's. This would be relatively straightforward for most events such as songs and commercials since their time lengths are already known in advance. ERT would be updated during broadcast of the current program event on a regular basis, such as about once per second. During transmission of data for multiple program events, an interleave scheme is preferably used in order to provide a relatively large amount of information while insuring that information concerning the current program event is available without significant delay. For example, program events could be broadcast according to their PEN in an order of 1, 2, 1, 3, 1, 4, and so on. The specific program events for inclusion in a program event list at any particular moment may be determined based on 1) the events occurring during a predetermined time interval (e.g., the next fifteen minutes of program content), or 2) a predetermined number of upcoming program events (e.g., the next eight events).

Figure 5:
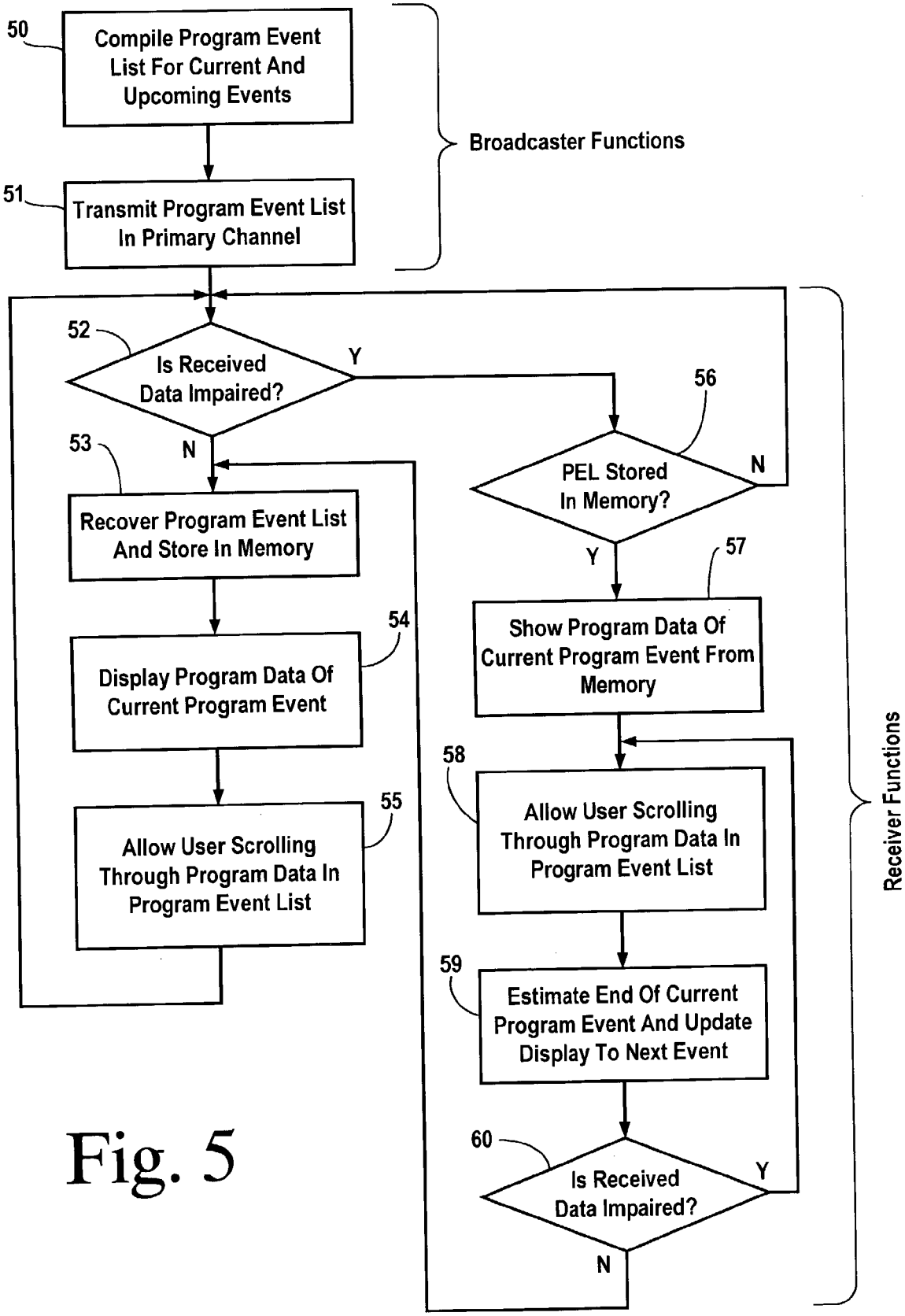
FIG. 5 is a flowchart showing a preferred method of the present invention.

A preferred method of the present invention is shown in greater detail in FIG. 5. In step 50, the broadcaster compiles a program event list for the current program event and upcoming program events. The program event list is transmitted in the primary channel in step 51. Preferably, the program event list is interleaved as previously described. A check is made in step 52 by the receiver to determine whether the reception of program data is impaired. If not impaired, then the radio receiver recovers the program event list in step 53 and stores it in memory. In step 54, the program data of the current program event is displayed by the radio receiver (e.g., shown on the visual display and/or audibly reproduced). The user/listener is allowed to scroll through program data in the program event list in step 55 using operator controls on the receiver (e.g., manual switches or a microphone for voice recognition). The received data is recurrently (i.e., continuously) checked for being impaired in step 52.

When step 52 detects impaired data, a check is made in step 56 to determine whether a program event list (PEL) is stored in memory. If not, then the display of program data fails, and a return is made to step 52 in order to continue checking for valid data. If a PEL was previously stored, then program data of a current program event is displayed from memory in step 57. During data display, the user is allowed to scroll through program data in the program event list in step 58. In a preferred embodiment wherein time information is included in the program event list, the end of a current program event is estimated in step 59 and the display is updated to the next program event when an amount of time has elapsed equal to the event remaining time of the current event when the digital data transmission was lost. A check is made in step 60 to determine whether received data continues to be impaired. If so, then a return is made to step 58. Otherwise, a return is made to step 53 for receiving the now unimpaired data.

Figure 6:
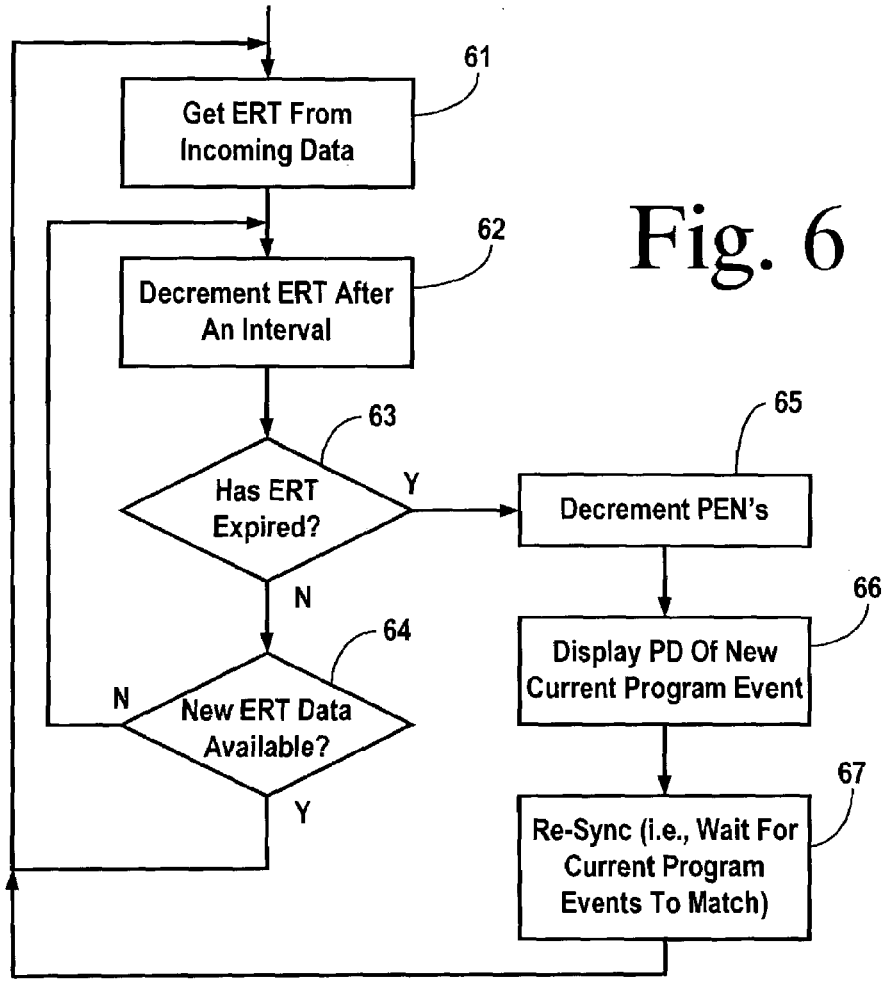
FIG. 6 is a flowchart showing a preferred method for updating display contents during times that program data is received.
Figure 7:
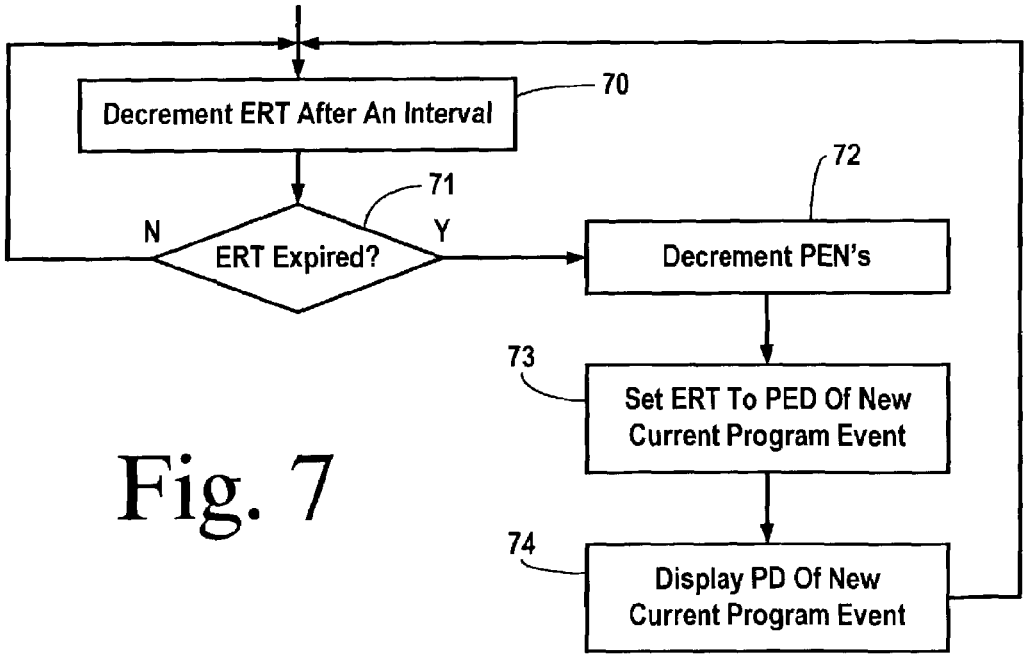
FIG. 7 is a flowchart showing a preferred method for updating display contents during times that reception of program data in a primary channel has become impaired.

FIGS. 6 and 7 illustrate the use of time information in greater detail. FIG. 6 shows the use of time information during times that unimpaired digital data is being received. In step 61, the ERT of the current program event is obtained from the incoming data. As previously described, the ERT of the current program event may be updated by the broadcaster about once per second. Between these updates, the ERT is decremented in step 62 after a predetermined interval (such as one millisecond), and a running value of the ERT is maintained internally by the radio receiver. A check is made in step 63 to determine whether the ERT has expired (i.e., counted down to zero). If not, then a check is made in step 64 to determine whether new ERT data is available. If not, then a return is made to step 62 for further decrementing of the internally maintained ERT. If new ERT data is available in step 64, then a return is made to step 61 to input the new ERT value. The foregoing steps permit precise matching of the updating of the display with the moment that the current program event changes without requiring that moment to be indicated in real time within the broadcast data stream.

When an expired ERT is detected in step 63, then the PENs of each event in the stored program event list are decremented in step 65 (and the entry for the old PEN #1 may be retained as a past event or discarded). Program data of the new current program event after decrementing (e.g., new PEN #1) is displayed in step 66. The program event list is preferably resynchronized in step 67, allowing the receiver to re-align the incoming program event list from the primary data channel in time with the decremented list.

Referring to FIG. 7, a preferred method is shown for updating the display of program data after is has been detected that incoming digital data is impaired or lost and that a PEL is stored in memory. After a predetermined interval (e.g., one millisecond), the ERT of the current program event is decremented in step 70. A check is made in step 71 to determine whether the ERT has expired. If not, then a return is made to step 70 for further decrementing. Once the ERT expires, the PEN's are decremented in step 72 (e.g., PEN #1 becomes past event #0 and PEN #2 becomes new PEN #1). In step 73, the ERT of the new current program event is set to the PED of the current program event. The program data of the new current program event is displayed in step 74 and a return is made to step 70. If the digital data of the primary channel is never recovered, the program event table may be cycled through until all events have been displayed, at which time no more data is available for the display. If enough program events are stored, the listener could see continuous program data for long periods of time. In addition, the user can access program data in memory to display both future and past events as previously described.

The protocol or format used for broadcasting a program event list may be comprised of any conventional data transmission technique. The program event can be inserted in the IBOC data stream as global or local indicators. If inserted globally, they may reside in the main header of a standard data message, for example. If inserted locally, they can reside either in the header or data portion for a data packet, such as an ID3 tag.

Several message protocols for transmitting a program event list are shown in FIGS. 8–11. FIG. 8 shows inclusion of data for a program event in an extended header between a standard header and the data portion of a data packet. As shown in FIG. 9, the program event indicators for a program event can be embedded in the frame data of an ID3 data packet. In the frame data portion, "<<PEI" indicates the start of the program event indicators and ">>;" indicates the end of the program event indicators.

FIG. 10 shows the use of a selected ID3 frame, such as a COMM or comment frame, to transmit program event data. Preferably, the current program event data would be broadcast in their usual frames while data for upcoming events are all sent using the COMM frame.

As shown in FIG. 11, a new type of ID3 frame can be defined for transmitting the program event data. A new frame ID is introduced such as PEVT (to indicate a program event).

Other alternatives include 1) embedding the PEN and PET data in an extended ID3 header and using the TIME and TLEN frames to transmit PED and ERT data, respectively, and 2) defining a new data format altogether.

The broadcasting of a program event list including program data allows a radio receiver to handle data display in a more robust fashion. Data for a current program event is displayed while data for future upcoming program events and past events are stored in memory. The storage of a program event list allows the radio receiver to provide functions that are very useful to the listener, such as "look-ahead" or "look-back", and the display of data for periods of time when the digital signal is not available. In addition, an intelligent scrolling function may be provided wherein a search of the program event list is performed based on a characteristic identified by the listener. For example, the listener can skip through upcoming events seeing only those events matching a certain criteria such as a selected program event type. The listener can provide search characteristics, such as a desired PET or specified text in the PAD (e.g., a desired genre or artist), using the manual controls or voice commands, for example.

In an all digital broadcast, the digital backup channel may in some instances include a subset of the program data that is broadcast in the primary channel. When the receiver blends to the backup channel, the stored program event list and the currently received data from the backup channel can both supply program data for display to the user of the receiver. For example, the backup channel may include a program event list with a smaller number of entries or a PEL having just a subset of the data fields. Updates to the ERT may be transmitted less frequently in the backup channel.

It is also possible that a hybrid broadcast could include subsets of the program data in the backup channel. For example, the backup channel could provide program data using a signal that is modulated differently than the primary channel and doesn't interfere with the main audio program in the backup. In this case, the program data in the backup channel could also duplicate some of the program data found in the primary channel, possibly at the same or at a lesser data rate. The receiver would demodulate and decode data from the backup channel using appropriate means, determine the types of program data available, and control display of the program data in a manner similar to that described for an all-digital broadcast with program data in the backup channel.

What is claimed is:

1. A method of providing program data in association with a main audio program to a receiver of a duplicative radio broadcasting system wherein a duplicative broadcast includes a primary channel and a backup channel in a predetermined frequency allocation, wherein both said primary channel and said backup channel transmit said main audio program to said receiver, wherein said primary channel transmits program data not included in said backup channel, and wherein said receiver includes an audio output for reproducing said main audio program and a display for displaying said program data, said method comprising the steps of:

recurrently compiling a program event list of said program data corresponding to a current program event and a plurality of upcoming program events of said main audio program;

recurrently transmitting said event list within said primary channel;

recurrently recovering said program event list in said receiver and storing said program data in a memory;

displaying said program data of said current program event of said main audio program;

blending said audio output from said primary channel to said backup channel in response to detection of an impaired primary channel; and updating said display to show program data of one of said upcoming program events of said main audio program from said memory during impairment of said program data in said primary channel.

2. The method of claim 1 wherein said program event list includes timing information indicative of a duration of respective program events and wherein said step of updating said display comprises indexing said display between program events in response to said timing information.

3. The method of claim 1 wherein said step of updating said display comprises operator-controlled scrolling through said program event list.

4. The method of claim 1 wherein said primary channel is comprised of a digital broadcast signal and said backup channel is comprised of an analog broadcast signal.

5. The method of claim 1 wherein said primary channel is comprised of a first digital broadcast signal and said backup channel is comprised of a second digital broadcast signal lacking at least a portion of said program data being displayed.

6. The method of claim 1 further comprising the step of:

scrolling through said program event list on said display when said primary channel is unimpaired.

7. The method of claim 6 wherein said scrolling step is comprised of selecting a criteria for matching, searching said program event list for a match, and displaying a matching program event.

8. The method of claim 1 wherein each of said events in said program event list is comprised of a program event number and program data for a respective event.

9. The method of claim 8 wherein each of said events further includes a program event type.

10. The method of claim 8 wherein each of said events further includes a program event duration.

11. The method of claim 8 wherein each of said events further includes an event remaining time.

12. The method of claim 11 wherein said event remaining time is updated and retransmitted at a frequency of at least about once per second.

13. The method of claim 1 wherein a plurality of instances of said current program event are Interleaved with said upcoming program events during transmission.

14. The method of claim 1 wherein said display includes a text-to-speech converter and wherein said step of displaying said program data is comprised of audibly reproducing said program data.

15. A method of providing program data in association with a main audio program in a radio receiver for receiving a duplicative broadcast from a duplicative radio broadcasting system, wherein said duplicative broadcast includes a primary channel and a backup channel in a predetermined frequency allocation, wherein both said primary channel and said backup channel transmit said main audio program to said receiver, wherein said primary channel recurrently transmits a recurrently compiled program event list of said program data corresponding to a current program event and a plurality of upcoming program events of said main audio program, and wherein said radio receiver includes an audio output for reproducing said main audio program and a display for displaying said program data, said method comprising the steps of:

recurrently recovering said program event list in said radio receiver and storing said program data in a memory;

displaying said program data of said current program event of said main audio program;

blending said audio output from said primary channel to said backup channel in response to detection of an impaired primary channel; and updating said display to show program data of one of said upcoming program events of said main audio program from said memory during impairment of said program data in said primary channel.

16. The method of claim 15 wherein said program event list includes timing information indicative of a duration of respective program events and wherein said step of updating said display comprises indexing said display between program events in response to said timing information.

17. The method of claim 15 wherein said current program event in said program event list is comprised of a program event number, a program event duration, an event remaining time, and program-associated data, wherein said upcoming program events in said program event list are each comprised of a program event number, a program event duration, and program-associated data for a respective upcoming program event, and when said program event list is being received within said primary channel then said method further comprises the steps of:

recurrently updating said event remaining time of said current program event;

decrementing from each updated event remaining time;

detecting expiration of said event remaining time;

decrementing said program event numbers so that a next upcoming program event becomes said current program event;

retrieving and displaying program data from said new current program event; and re-aligning said stored program event list with said program event list received from said primary channel.

18. The method of claim 17 wherein said updating during said blending to said backup channel comprises the steps of:

decrementing from a last-received event remaining time;

detecting expiration of said last-received event remaining time;

decrementing said program event numbers so that a next upcoming program event becomes said current program event and said program event duration of said next upcoming program event becomes said last-received event remaining time;

retrieving and displaying program data from said new current program event; and repeating said foregoing steps until said program event list is again received from said primary channel or said stored program event list is depleted.

19. The method of claim 15 further comprising the step of scrolling through said program event list on said display.

20. The method of claim 19 wherein said scrolling step is comprised of selecting a criteria for matching, searching said program event list for a match, and displaying a matching program event.

21. The method of claim 15 wherein said primary channel is comprised of a digital broadcast signal and said backup channel is comprised of an analog broadcast signal in an in-band on-channel broadcast service.

22. The method of claim 15 wherein said primary channel is comprised of a first digital broadcast signal and said backup channel is comprised of a second digital broadcast signal lacking at least a portion of said program data being displayed.

23. A radio receiver for receiving a duplicative broadcast from a duplicative radio broadcasting system, wherein said duplicative broadcast includes a primary channel and a backup channel in a predetermined frequency allocation, wherein both said primary channel and said backup channel transmit a main audio program to said receiver, wherein said primary channel transmits a recurrently compiled program event list of program data corresponding to a current program event and a plurality of upcoming program events of said main audio program, said radio receiver comprising:

an audio output for reproducing said main audio program from either said primary channel or said backup channel according to relative received signal quality;

an interface for communicating said program data;

a detector for recurrently recovering said program event list;

a memory for storing said program event list; and a controller for updating said interface to communicate program data of one of said upcoming program events of said main audio program from said memory during impairment of said program data in said primary channel.

24. The radio receiver of claim 23 wherein said program event list includes timing information indicative of a duration of respective program events and wherein said controller automatically indexes said interface between program events in response to said timing information.

25. The radio receiver of claim 23 further comprises operator controls for scrolling through said program event list.

26. The radio receiver of claim 25 wherein said operator controls include voice recognition.

* * * * *

UNITED STATES PATENT AND TRADEMARK OFFICE

CERTIFICATE OF CORRECTION

PATENT NO. : 7,228,100 B2
APPLICATION NO. : 10/397037
DATED : June 5, 2007
INVENTOR(S) : Todd A. Toporski et al.

It is certified that error appears in the above-identified patent and that said Letters Patent is hereby corrected as shown below:

In the Claims

Columns 7-8, in claim 1, line 17, after "transmitting said" insert --program--.

Column 8, in claim 13, line 2, after "program event are" delete "Interleaved" and susbstitute --interleaved--in its place.

Column 10, in claim 19, line 1, immediately after "comprising the step of" insert --:-- (colon).

Signed and Sealed this

Twenty-eighth Day of August, 2007

JON W. DUDAS
*Director of the United States Patent and Trademark Office*